US011668515B2

(12) United States Patent
Chezem

(10) Patent No.: US 11,668,515 B2
(45) Date of Patent: Jun. 6, 2023

(54) APPLIANCE STORAGE BIN WITH AN OVER-MOLDED GLASS PANEL

(71) Applicant: Haier US Appliance Solutions, Inc., Wilmington, DE (US)

(72) Inventor: Michael Thomas Chezem, Georgetown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/359,835

(22) Filed: Jun. 28, 2021

(65) Prior Publication Data

US 2022/0412644 A1 Dec. 29, 2022

(51) Int. Cl.

| | |
|---|---|
| ***F25D 23/04*** | (2006.01) |
| ***F25D 27/00*** | (2006.01) |
| ***F25D 23/12*** | (2006.01) |
| ***F25D 23/08*** | (2006.01) |

(52) U.S. Cl.

CPC ..... *F25D 23/04* (2013.01); *F25D 23/08* (2013.01); *F25D 23/123* (2013.01); *F25D 27/00* (2013.01)

(58) Field of Classification Search

CPC ..... F25D 23/04; F25D 23/08; F25D 23/123; F25D 25/005; F25D 25/022; F25D 27/00; F25D 2325/022

See application file for complete search history.

(56) References Cited

U.S. PATENT DOCUMENTS

| | | | | | |
|---|---|---|---|---|---|
| 5,564,809 | A * | 10/1996 | Kane | B29C 33/126 | 211/193 |
| 5,677,030 | A | 10/1997 | Limansky | | |
| 6,120,720 | A * | 9/2000 | Meier | B29C 45/14377 | 264/261 |
| 6,174,482 | B1 * | 1/2001 | Reames | B29C 45/14434 | 264/250 |
| 2003/0038571 | A1 * | 2/2003 | Obrock | C03B 35/185 | 312/408 |
| 2012/0297816 | A1 * | 11/2012 | Czach | F25D 23/04 | 62/377 |
| 2015/0023000 | A1 * | 1/2015 | Kendall | F25D 25/02 | 362/249.02 |

FOREIGN PATENT DOCUMENTS

| | | | | |
|---|---|---|---|---|
| CN | 202675787 U | | 1/2013 | |
| DE | 102011006798 | A1 * | 10/2012 | F25D 23/04 |
| DE | 102015203189 | A1 * | 8/2016 | |
| EP | 0962731 | A1 * | 12/1999 | F25D 23/04 |
| EP | 0974796 | A1 * | 1/2000 | F25D 23/04 |
| EP | 0974796 | A1 | 1/2000 | |
| WO | WO-2014090696 | A1 * | 6/2014 | F25D 23/04 |
| WO | WO-2020178119 | A1 * | 9/2020 | |

* cited by examiner

*Primary Examiner* — Andrew M Roersma
(74) *Attorney, Agent, or Firm* — Dority & Manning, P.A.

(57) ABSTRACT

A storage bin for an appliance includes a single piece of molded plastic and a glass front panel. The single piece of molded plastic forms one or more of a bottom wall, a rear wall, and a pair of side walls. The glass front panel is insert-molded within the single piece of molded plastic to form a front wall. The front wall, the bottom wall, the rear wall, and the pair of side walls collectively define an interior storage volume. The bottom wall is imperforate. A method for constructing a storage bin is also provided.

10 Claims, 4 Drawing Sheets

APPLIANCE STORAGE BIN WITH AN OVER-MOLDED GLASS PANEL

FIELD OF THE INVENTION

The present disclosure relates generally to storage bins for appliances.

BACKGROUND OF THE INVENTION

Refrigerator appliances generally include a cabinet that defines a chilled chamber for receipt of food articles for storage. Various storage components are often mounted within the chilled chamber and are designed to facilitate storage of food items therein. Such storage components can include racks, bins, shelves, or drawers that receive food items and assist with organizing and arranging of such food items within the chilled chamber.

Known storage components are constructed of plastic and frequently have a utilitarian appearance. Constructing storage components of materials other than plastic can provide a desirable appearance but is prohibitively expensive. Moreover, constructing a spill-proof storage component with materials other than plastic can be difficult.

BRIEF DESCRIPTION OF THE INVENTION

The present subject matter provides a bin with an insert-molded glass panel that forms a front wall of the bin. A bin may be spill-proof. Thus, liquid spilled within an interior of the bin may be unable to penetrate or pass through a bottom of the bin, i.e., to flow out of the interior of the bin via the bottom of the bin. The glass panel may provide a pleasant, high-end cosmetic appearance, e.g., without providing a flow path for liquid out of the bin.

One example aspect of the present disclosure is directed to a storage bin for an appliance that includes a single piece of molded plastic and a glass front panel. The single piece of molded plastic forms one or more of a bottom wall, a rear wall, and a pair of side walls. The glass front panel is insert-molded within the single piece of molded plastic to form a front wall. The front wall, the bottom wall, the rear wall, and the pair of side walls collectively define an interior storage volume. The bottom wall is imperforate.

Another example aspect of the present disclosure is directed to a method for constructing a storage bin for an appliance. The method includes positioning a glass panel within a mold body and injecting plastic into the mold body with the glass panel. One or more of a bottom wall, a rear wall, and a pair of side walls of the storage bin are formed from the plastic after injecting the plastic into the mold body. A front wall of the storage bin is formed with the glass panel after injecting the plastic into the mold body. The front wall, the bottom wall, the rear wall, and the pair of side walls collectively define an interior storage volume, and the bottom wall is imperforate.

Variations and modifications may be made to these example embodiments of the present disclosure. These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
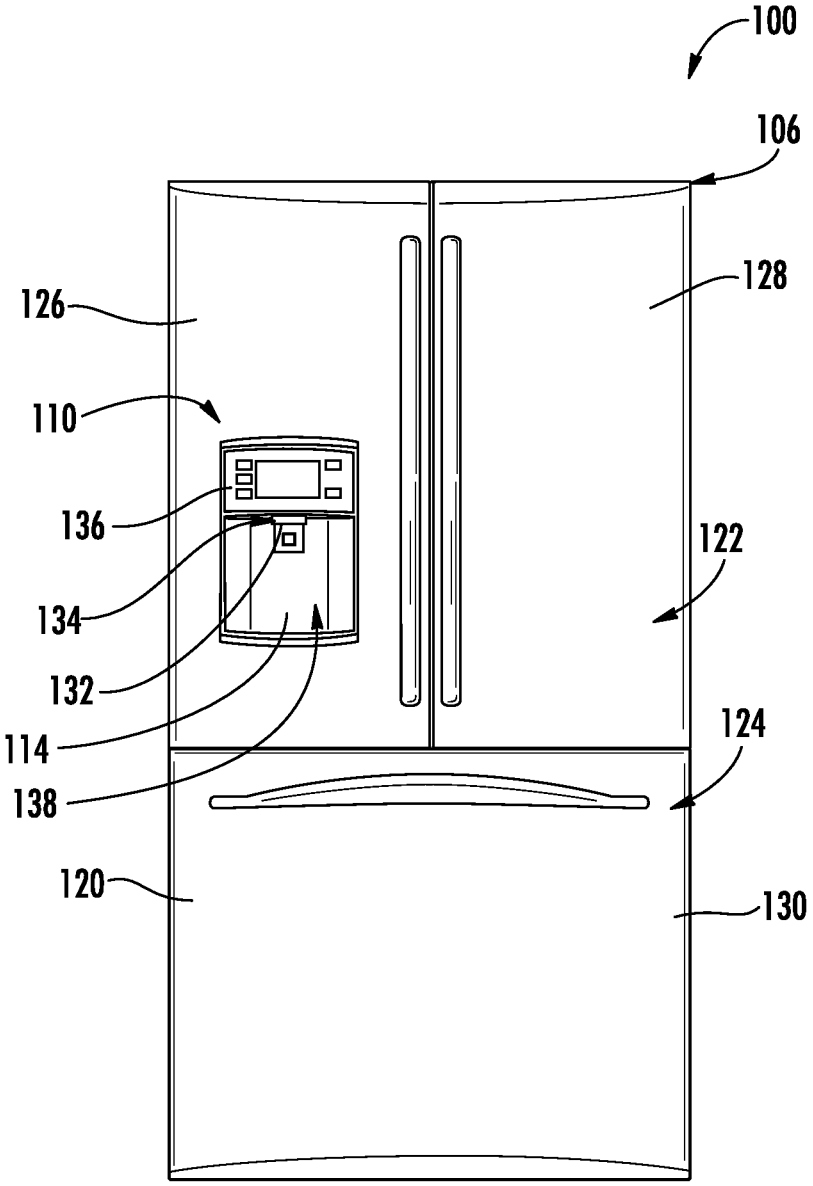
FIG. 1 is a front, elevation view of a refrigerator appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment may be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin. As used herein and consistent with the art, the term "spill-proof" is used to refer to the ability of a storage unit to retain twelve ounces (12 oz.) or about three-hundred and fifty milliliters (350 ml.) of fluid for at least twenty-four (24) hours. Lesser performance is generally referred to as "spill-resistant."

Example aspects of the present disclosure are directed to a storage bin for an appliance. The storage bin may include a single, unitary piece of molded plastic and a glass front panel. The single piece of molded plastic may form one or more of a bottom wall, a rear wall, and a pair of side walls, and the glass front panel may be insert-molded within the single piece of molded plastic to form a front wall. The front wall, the bottom wall, the rear wall, and the pair of side walls collectively define a spill-proof interior storage volume. Thus, liquid spilled within the interior storage volume may be unable to penetrate or pass through the bottom wall, i.e., to flow out of the interior storage volume. The glass front panel may provide a pleasant, high-end cosmetic appearance, e.g., without providing a flow path for liquid out of the bin.

Referring now to the figures, FIG. 1 depicts a front view of an example embodiment of a refrigerator appliance 100. Refrigerator appliance 100 includes a cabinet or housing 120 defining an upper fresh food chamber 122 and a lower freezer chamber 124 arranged below the fresh food chamber 122. As such, refrigerator appliance 100 is generally referred to as a bottom-mount refrigerator appliance. In the exemplary embodiment, housing 120 also defines a mechanical compartment (not shown) for receipt of a sealed cooling system. Using the teachings disclosed herein, one of skill in the art will understand that the present invention may be used with other types of refrigerator appliances (e.g., side-by-sides or top-mounts). Consequently, the description set forth herein is for illustrative purposes only and is not intended to limit the invention to any particular style of refrigerator appliance or arrangement of chilled chambers.

Refrigerator doors 126, 128 are rotatably hinged to an edge of housing 120 for accessing fresh food compartment 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Refrigerator appliance 100 includes a dispensing assembly 110 for dispensing liquid water and ice. Dispensing assembly 110 includes a dispenser 114 positioned on an exterior portion of refrigerator appliance 100. Dispenser 114 includes a discharging outlet 134 for accessing ice and liquid water. Dispensing assembly 110 further includes a sensor 112 positioned on discharging outlet 134. As will be described in more detail below, sensor 112 may be configured to detect a presence of a container positioned within dispensing assembly 110, and to detect the top lip of the container. A user interface panel 136 is provided for controlling the mode of operation. For example, user interface panel 136 includes a water dispensing button (not labeled) and an ice-dispensing button (not labeled) for selecting a desired mode of operation such as crushed, non-crushed ice, or liquid water, etc.

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or liquid water and enabling the user to access ice or liquid water without the need to bend-over and without the need to access freezer chamber 124. In the exemplary embodiment, recessed portion 138 is positioned at a level that approximates the chest level of a user.

Operation of the refrigerator appliance 100 is regulated by a controller (not shown) that is operatively coupled to user interface panel 136 and/or sensor 112. Panel 136 provides selections for user manipulation of the operation of refrigerator appliance 100 such as e.g., selections between whole or crushed ice, chilled liquid water, and/or other options. In response to user manipulation of the user interface panel 136, the controller operates various components of the refrigerator appliance 100. The controller may be positioned in a variety of locations throughout refrigerator appliance 100. In the illustrated embodiment shown in FIG. 1, the controller is located within beneath the user interface panel 136 on door 126. In such an embodiment, input/output ("I/O") signals may be routed between controller and various operational components of refrigerator appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electromechanical input devices including rotary dials, push buttons, and touch pads. The user interface 136 may be in communication with the controller via one or more signal lines or shared communication busses.

Figure 2:
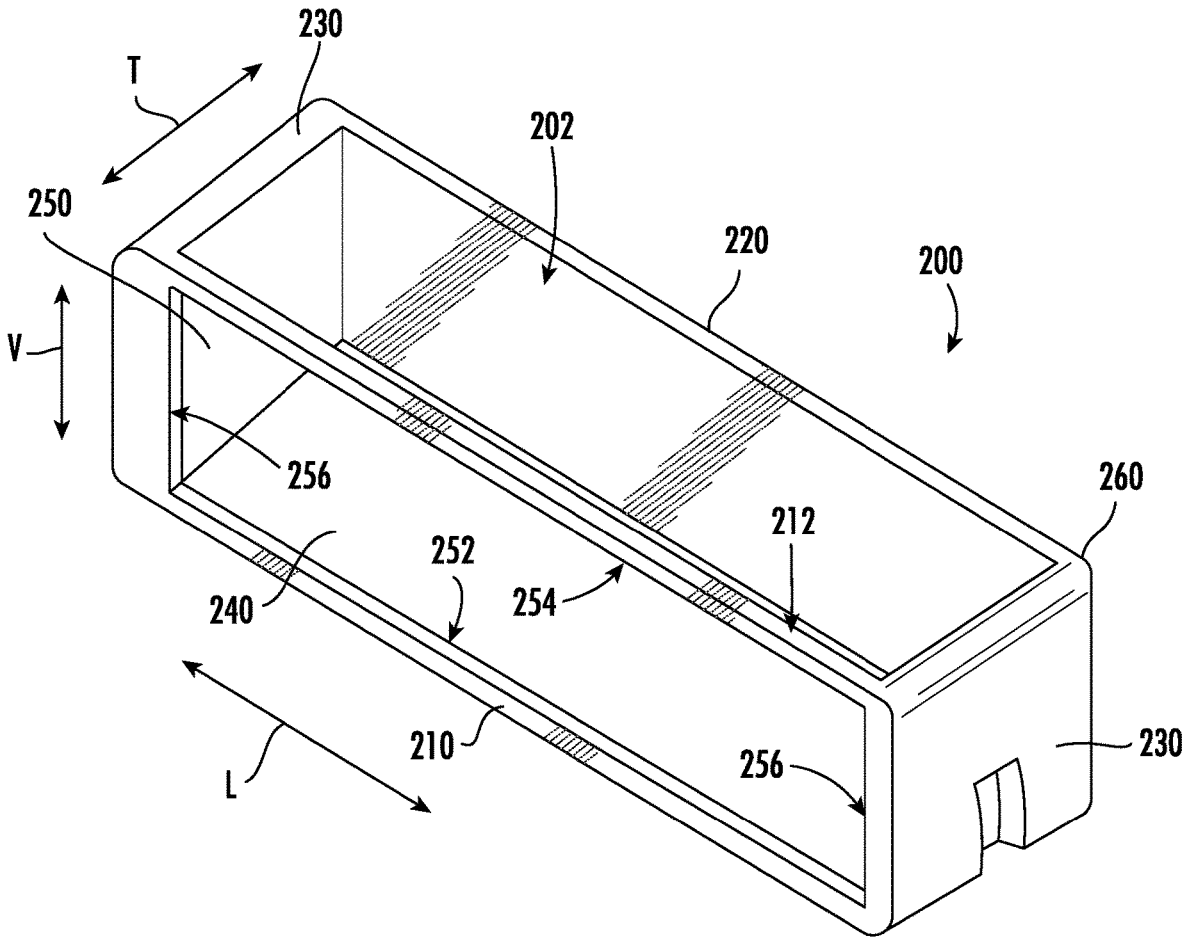
FIG. 2 is a perspective view of a storage bin according to an example embodiment of the present disclosure.

FIG. 2 is a perspective view of a storage bin 200 according to an example embodiment of the present subject matter. Storage bin 200 may be used in or with any suitable appliance, such as a refrigerator appliance, a freezer appliance, etc. For example, storage bin 200 may be used in refrigerator appliance 100, e.g., within fresh food chamber 122 or freezer chamber 124, to facilitate storage of food items within housing 120. Thus, storage bin 200 is described in greater detail below in the context of refrigerator appliance 100. As discussed in greater detail below, storage bin 200 includes an integrated glass panel, e.g., while being constructed to be spill-proof. Storage bin 200 may define a vertical direction V, a lateral direction L, and a transverse direction T that are mutually perpendicular and form an orthogonal direction system.

As shown in FIG. 2, storage bin 200 includes a bottom wall 210, a rear wall 220, a pair of side walls 230, and a front wall 240. Front wall 240 and rear wall 220 may be spaced apart along the transverse direction T, and front and rear walls 240, 220 may extend along the lateral direction L between side walls 230. Front and rear walls 240, 220 may also be disposed parallel to each other. Side walls 230 may be spaced apart along the lateral direction L, and side walls 230 may extend along the transverse direction T between front and rear walls 240, 220. Front, side, and rear walls 240, 230, 220 may also extend upwardly along the vertical direction V from bottom wall 210. Side walls 230 may include mounting slots for mounting storage bin 200 within refrigerator appliance 100.

Bottom wall 210, rear wall 220, side walls 230, and front wall 240 may collectively define an interior storage volume 202. Food items, such as bottles, jars, jugs, etc., may be disposed within interior storage volume 202. A top of storage bin 200 may be open such that interior storage volume 202 is accessible at the top of storage bin 200. Thus, e.g., storage bin 200 may not include a top wall over interior storage volume 202.

A height of storage bin 200, e.g., along the vertical direction V, may be selected to provide a suitable depth for interior storage volume 202. For example, the height of storage bin 200 (e.g., interior storage volume 202) along the vertical direction V may be no less than five centimeters (5 cm), no less than eight centimeters (8 cm), no less than ten centimeters (10 cm), etc. Thus, storage bin 200 may be sized for receipt of bottles, jars, jugs, etc. within interior storage volume 202.

Storage bin 200 includes at least one glass panel 250 and a single, unitary piece of molded plastic 260. As shown in FIG. 2, glass panel 250 may be positioned at and form front wall 240. Moreover, glass panel 250 may be insert molded within molded plastic 260 to form front wall 240. Molded plastic 260 may form one or more of bottom, side, and rear walls 210, 220, 230. For instance, molded plastic 260 may form each of bottom, side, and rear walls 210, 220, 230 while glass panel 250 is insert molded within molded plastic 260 to form front wall 240.

By insert molding glass panel 250 within molded plastic 260, storage bin 200 may have a cosmetically pleasing appearance, e.g., relative to a bin formed within only molded plastic. Moreover, by insert molding glass panel 250 within molded plastic 260, storage bin 200 may formed such that interior storage volume 202 is spill-proof. Thus, e.g., bottom wall 210 may be imperforate and a bottom edge 252 of glass panel 250 may be encased within molded plastic 260 at bottom wall 210. Such positioning may form storage bin 200 with glass panel 250 while also blocking fluid flow from interior storage volume 202. For example, the interface between glass panel 250 and molded plastic 260 proximate bottom wall 210 may be formed such that no gap is present between glass panel 250 and molded plastic 260 proximate bottom wall 210 or such that any gap is insufficient for fluid to flow out of interior storage volume 202. Moreover, bottom edge 252 of glass panel 250 may be positioned below a top surface 212 of bottom wall 210 along the vertical direction V. Top surface 212 of bottom wall 210 may face interior storage volume 202. Thus, storage bin 200 may formed with glass panel 250 while also being spill-proof.

Figure 3:
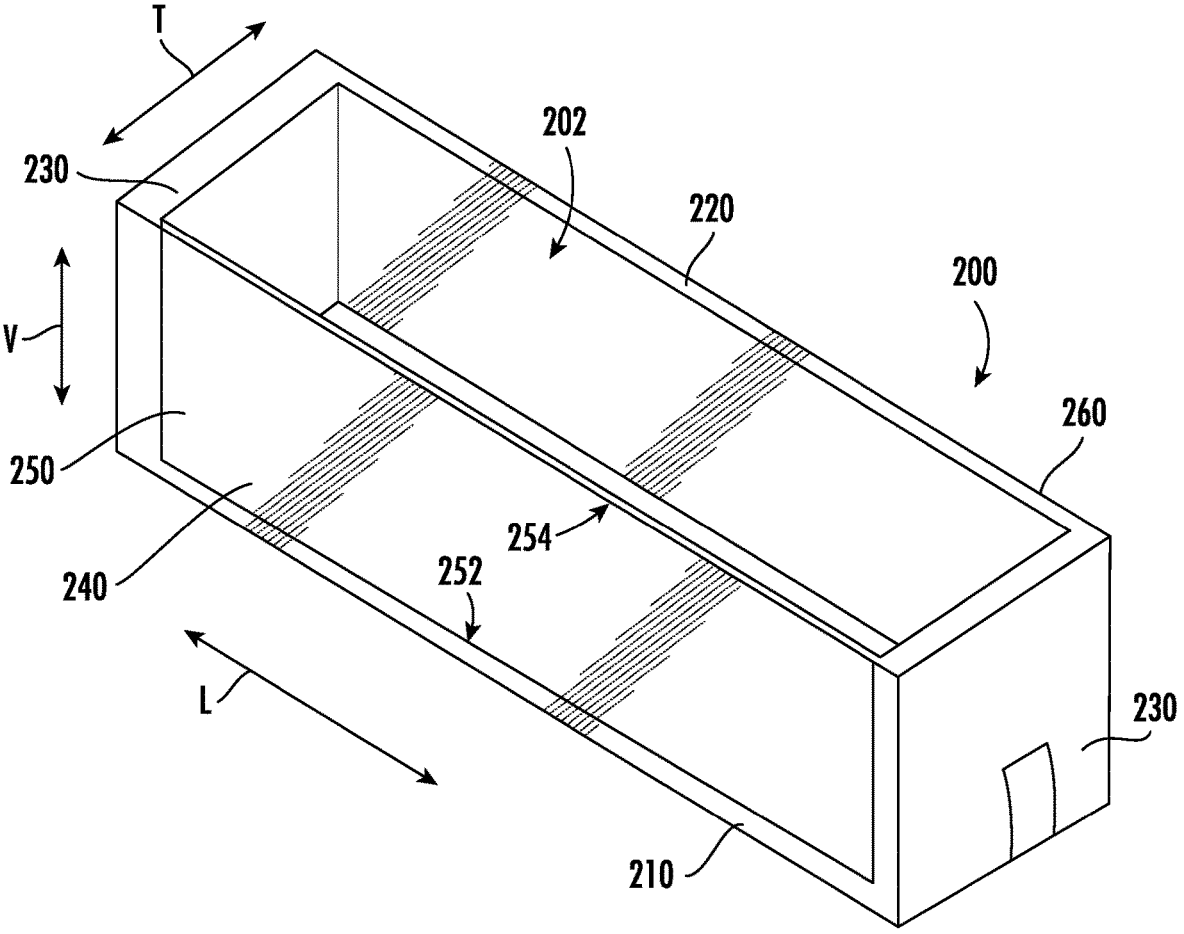
FIG. 3 is a perspective view of a storage bin according to another example embodiment of the present disclosure.

As shown in FIGS. 2 and 3, glass panel 250 may be a rectangular glass panel. In FIG. 2, each side of the four sides of rectangular glass panel 250 are encased within molded plastic 260. Conversely, in FIG. 3, one side (e.g., at a top edge 254 of glass panel 250) may be exposed and not encased within molded plastic 260 while the other three sides (e.g., at bottom edge 252 and both side edges 256 of glass panel) may be encased within molded plastic 260. Thus, in certain example embodiments, top edge 254 of glass panel 250 may be exposed and visible. Conversely, each edge of glass panel 250 may encased within molded plastic 260 in certain example embodiments.

Figure 4:
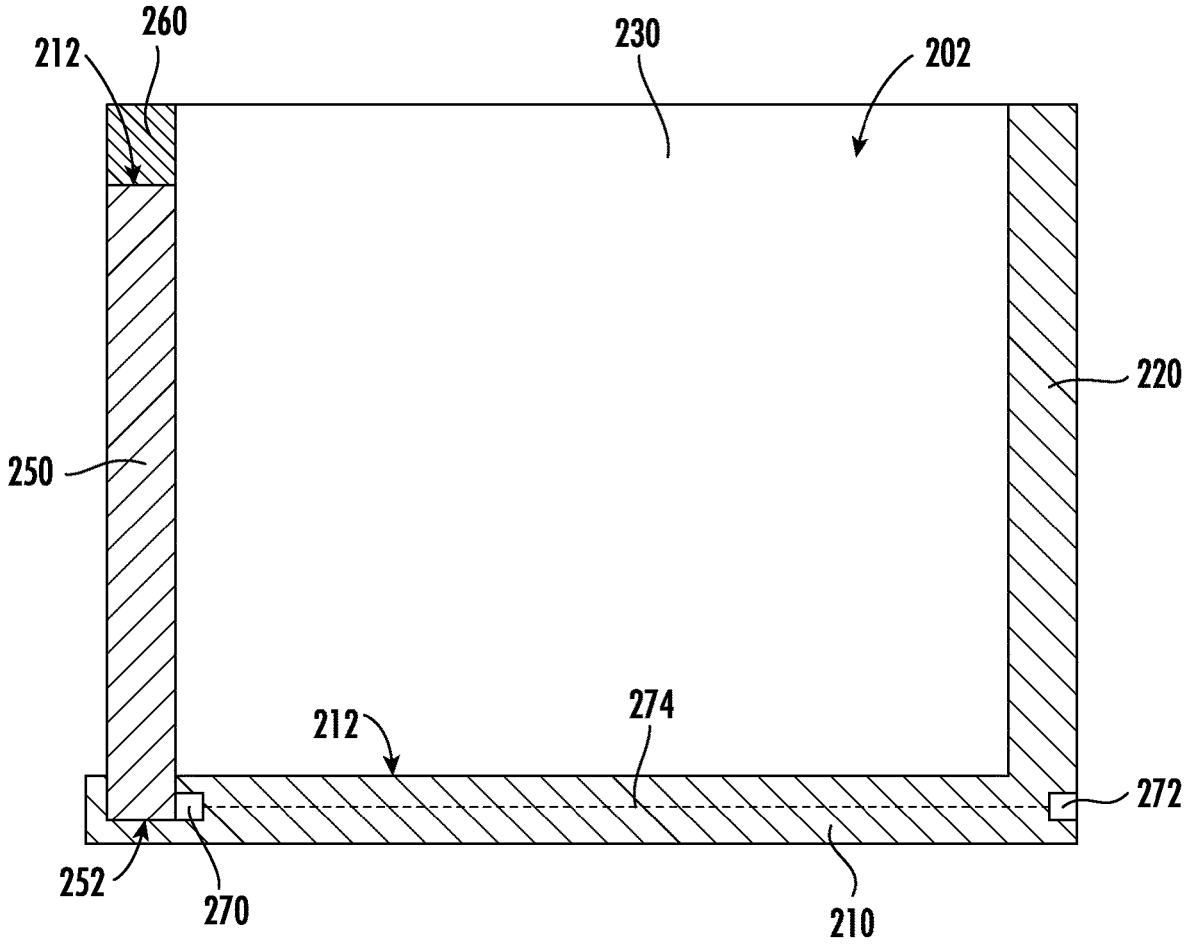
FIG. 4 is a section view of the example storage bin of FIG. 2.

Turning to FIG. 4, storage bin 200 may include a light source 270. Light source 270 may be positioned at one or more of bottom wall 210 and side walls 230. Light source 270 may be operable to illuminate glass panel 250. For instance, light source 270 may be activated to emit lighted into glass panel 250. Moreover, light source 270 may be positioned such that at least a portion of the light from light source 270 is internally reflected within glass panel 250. In certain example embodiments, light source 270 may be a plurality of light emitting diodes, e.g., such as a string of light emitting diodes. The light emitting diodes of light source 270 may be positioned at bottom wall 210 and distributed along bottom edge 252 of glass panel 250. For instance, the light emitting diodes of light source 270 may be positioned below bottom edge 252 of glass panel 250 along the vertical direction V and/or be oriented to emit light upwardly along the vertical direction V into glass panel 250.

Storage bin 200 may also include an electrical connector 272 and an electrical conduit 274. Connector 272 may be positioned at rear wall 220. Conduit 274 may extend between and electrically couple connector 272 and light source 270. Connector 272 is connectable to a corresponding electrical connector on refrigerator appliance 100. As an example, connector 272 on storage bin 200 may be one of a socket or a plug, and the connector on refrigerator appliance 100 may be the other one of the socket or the plug. The connector on refrigerator appliance 100 may be disposed on one of doors 126, 128 or housing 120. Connector 272 and conduit 274 may be configured to assist with forming an electrical circuit for light source 270. For example, from the interface formed by connector 272, conduit 274 may supply electric power from refrigerator appliance 100 to operate light source 270.

Storage bin 200 may be formed by insert-molding glass panel 250 within plastic 260. Thus, to form storage bin 200, glass panel 250 may be positioned within a mold body. With glass panel 250 positioned within the mold body, a remaining void space within the mold body may correspond to the shape of bottom wall 210, rear wall 220, and side walls 230. Subsequently, plastic 260 may be injection molded into the mold body with glass panel 250 to form bottom wall 210, rear wall 220, and side walls 230 with molded plastic 260 and insert-mold glass panel 250 within molded plastic 260 to form front wall 240 with glass panel 250.

While shown and described with only one glass panel 250 to form front wall 240, it will be understood that storage bin 200 may include one or more additional glass panels in alternative example embodiments. In the same manner described above for glass panel 250 to form front wall 240, the one or more additional glass panels may be used to form a respective one or more of bottom wall 210 and side walls 230. Thus, other walls of storage bin 200 may be formed by insert molding a glass panel within molded plastic 260 in alternative example embodiments.

Storage bin 200 may also include metal panels on side walls 230 in certain example embodiments. The metal panels may be shaped to complement and conform to side walls 230 and may provide a pleasant cosmetic contrast to glass panel 250 and molded plastic 260.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A storage bin for an appliance, comprising:

a single piece of molded plastic forming a bottom wall, a rear wall, and a pair of side walls;

a glass front panel insert-molded within the single piece of molded plastic to form a front wall; and a light source positioned at one or more of the bottom wall and the pair of side walls, the light source operable to illuminate the glass panel, wherein a bottom edge of the glass panel is inset within the bottom wall, wherein the glass panel is a rectangular glass panel, and each side of the rectangular glass panel is encased within the single piece of molded plastic, and wherein the front wall, the bottom wall, the rear wall, and the pair of side walls collectively define an interior storage volume, and the bottom wall is imperforate.

2. The storage bin of claim 1, wherein a top surface of the bottom wall faces the interior storage volume, and the bottom edge of the glass panel is positioned below the top surface of the bottom wall.

3. The storage bin of claim 1, wherein the light source comprises a plurality of light emitting diodes.

4. The storage bin of claim 3, wherein the plurality of light emitting diodes is positioned at the bottom wall and distributed along a bottom edge of the glass panel.

5. The storage bin of claim 1, further comprising an electrical connector and an electrical conduit, the connector positioned at the rear wall, the conduit extending between and electrically coupling the connector and the light source.

6. A method for constructing a storage bin for an appliance, comprising:

positioning a glass panel and a light source within a mold body; and injecting plastic into the mold body with the glass panel, wherein a bottom wall, a rear wall, and a pair of side walls of the storage bin are formed from the plastic after injecting the plastic into the mold body, and a front wall of the storage bin is formed with the glass panel after injecting the plastic into the mold body, wherein the light source is positioned at one or more of the bottom wall and the pair of side walls after injecting the plastic into the mold body, the light source operable to illuminate the glass panel, wherein a bottom edge of the glass panel is inset within the bottom wall, wherein the glass panel is a rectangular glass panel, and each side of the rectangular glass panel is encased within the plastic after injecting the plastic into the mold body, and wherein the front wall, the bottom wall, the rear wall, and the pair of side walls collectively define an interior storage volume, and the bottom wall is imperforate.

7. The method of claim 6, wherein a top surface of the bottom wall faces the interior storage volume, and the bottom edge of the glass panel is positioned below the top surface of the bottom wall.

8. The method of claim 6, wherein the light source comprises a plurality of light emitting diodes.

9. The method of claim 8, wherein the plurality of light emitting diodes is positioned at the bottom wall and distributed along a bottom edge of the glass panel.

10. The method of claim 6, further comprising mounting an electrical connector and an electrical conduit, the connector positioned at the rear wall, the conduit extending between and electrically coupling the connector and the light source.

* * * * *